United States Patent [19]

Gaynor

[11] 4,021,106

[45] May 3, 1977

[54] APPARATUS FOR ELECTROSTATIC REPRODUCTION USING PLURAL CHARGES

[75] Inventor: Joseph Gaynor, Cleveland, Ohio

[73] Assignee: Bell & Howell Company, Chicago, Ill.

[22] Filed: Aug. 15, 1974

[21] Appl. No.: 497,602

Related U.S. Application Data

[62] Division of Ser. No. 343,621, March 21, 1973, Pat. No. 3,843,361.

[52] U.S. Cl. ..... 355/3 R; 96/1 R

[51] Int. Cl.[2] ..... G03G 15/00

[58] Field of Search ..... 355/3 R, 16, 17; 96/1 R

[56] References Cited

UNITED STATES PATENTS

| | | | |
|---|---|---|---|
| 2,937,943 | 5/1960 | Walkup | 355/17 X |
| 3,066,298 | 11/1962 | McNaney | 355/16 X |
| 3,545,969 | 12/1970 | Herrick et al. | 96/1 R |
| 3,719,481 | 3/1973 | Makino et al. | 96/1 R |
| 3,820,985 | 6/1974 | Gaynor et al. | 355/3 BE |
| 3,853,397 | 12/1974 | Cantarano | 355/3 R |

OTHER PUBLICATIONS

"Electrophotography" by Schaffert, The Focal Press, pp. 94–96.

*Primary Examiner*—L. T. Hix
*Assistant Examiner*—J. A. LaBarre
*Attorney, Agent, or Firm*—Nilsson, Robbins, Dalgarn & Berliner

[57] ABSTRACT

An improved process for electrostatic reproduction. A transparent charged sheet of insulating material, such as a thin insulating film bearing a uniform electrostatic charge on one side thereof, or an electret, is placed against an electrostatically charged photoconductive surface on a suitable substrate to form a temporary composite. The photoconductive surface is then exposed to a light pattern and the free surface of the transfer sheet is developed to provide a visible image corresponding to the light pattern. This image is fixed on the transfer sheet or transferred to a receiving sheet after the transfer sheet has been removed from the photoconductive surface. Further copies can be made by reapplying the transfer sheet to the photoconductive surface and redeveloping the free surface of the transfer sheet when in place on the photoconductive surface.

Real electrostatic images can be provided on the free surface of the transfer sheet by charging it to a constant voltage, as with a constant voltage-variable current corona device, during or after light exposure. Multiple copies of the image can be obtained by placing the real electrostatic image side of the transfer sheet on a grounded conductor bearing a thin blocking layer and toner developing the opposite surface of the transfer surface of the transfer sheet.

In other embodiments, by simultaneously exposing and developing from opposite sides of the composite, high decay rate, but transparent, photoconductive materials can be used. In another method, the sandwich is simultaneously charged to constant voltage and exposed.

7 Claims, 14 Drawing Figures

FIG.7.
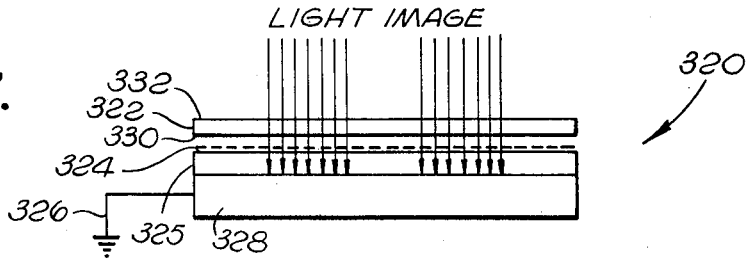
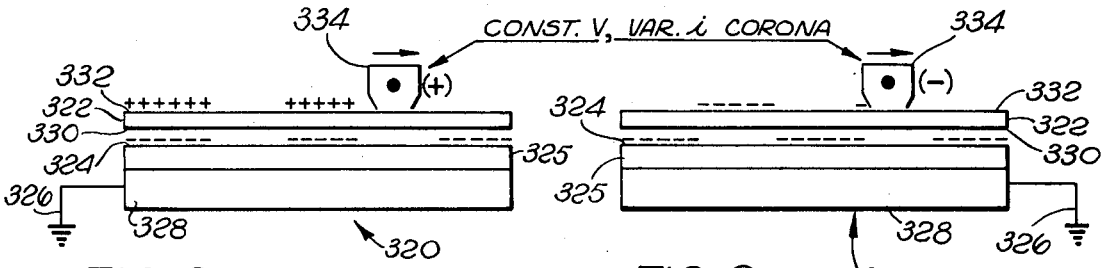
FIG.8A. FIG.8B.
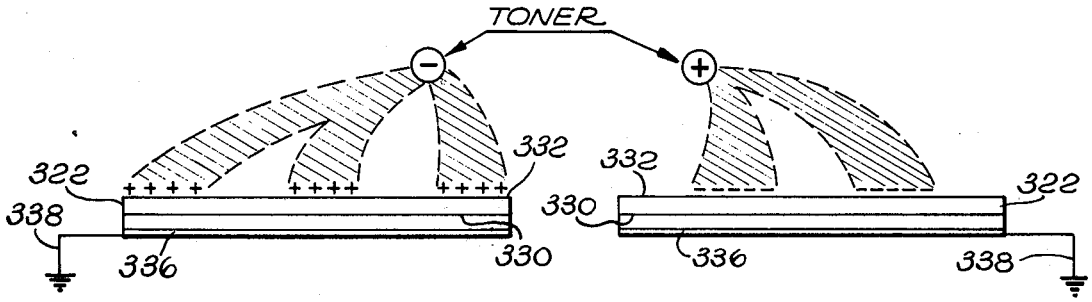
FIG.9A. FIG.9B.
FIG.10.
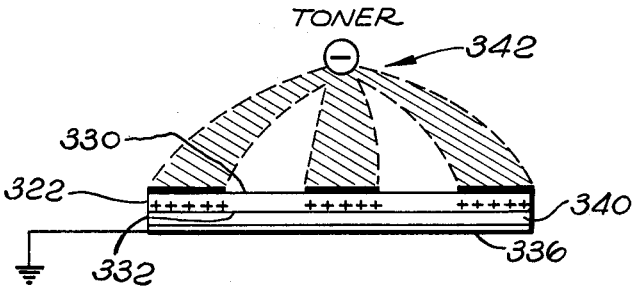

FIG.12.
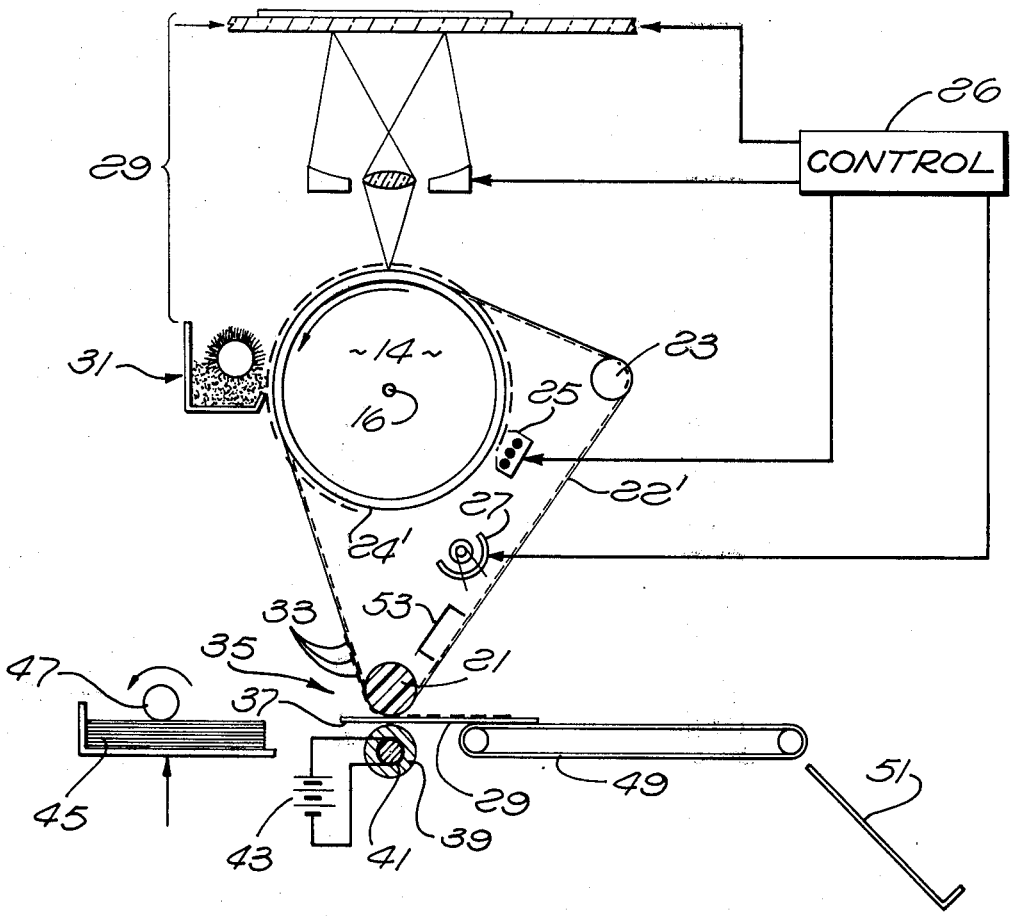
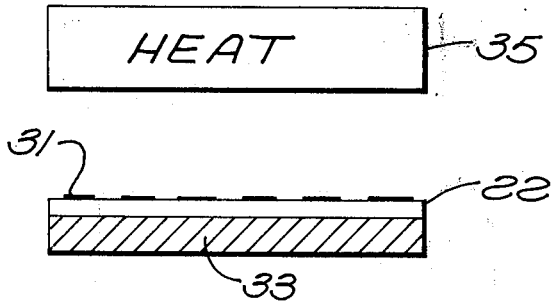
FIG.11.

APPARATUS FOR ELECTROSTATIC REPRODUCTION USING PLURAL CHARGES

This is a division of application Ser. No. 343,621,, filed Mar. 21, 1973, now U.S. Pat. No. 3,843,361.

FIELD OF THE INVENTION

The present invention generally relates to image reproduction and more particularly to improved processes for electrostatic image reproduction.

BACKGROUND AND SUMMARY OF THE INVENTION

In a typical method of xerographic reproduction, electric charges are deposited on a photoconductive surface by a corona discharge, after which the charged photoconductive surface is exposed to a light pattern to form a latent electrostatic image thereon. This latent image is then rendered visible by applying toner, which may be electrostatically charged powder or the like, directly to the photoconductive surface so that it adheres thereto in the latent image-bearing areas through electrostatic attraction. The resulting visible image is then fixed to a permanent image, as by heating or the like, to fuse it in place either directly on the photoconductive surface or print-off to a suitable copy sheet, such as paper.

The abrasivness of toner powder results in wear of the relatively expensive permanent photoconductive layers used in copying machines, thereby degrading the quality of copies and ultimately requiring the replacement of the photoconductive layers. Moreover, difficulties are encountered in fully transferring the visible image from the photoconductive surface to the copy and of keeping the toner powder from image-free areas. Gradual toner powder build-up on and around the photoconductive surface also degrades the copy quality, since inadverent toner transfer to copies causes the copies to appear gray and splotchy in background areas, reducing contrast and definition.

An additional problem with such reproduction procedures is that a separate exposure of the photoconductive surface is needed for each copy, that is, multiple copies cannot be made from a single exposure of the photoconductive surface. In addition, multiple copies bearing two or more different toner colors cannot be made.

Certain newer xerographic processes have been developed to overcome some of the foregoing drawbacks but are usually relatively complicated and are not adapted for use in simple, inexpensive copying machines.

In copending U.S. patent application, Ser. NO. 215,873, now U.S. Pat. No. 3,820,985, filed Jan. 6, 1972 by Joseph Gaynor, Terry G. Anderson, Walter Hines and Len A. Tyler, and assigned to the present assignee, an improved simple electrostatic copying process is provided which permits multiple copies from a single exposure and allows multiple color copying. In that process a thin insulating film is disposed on an electrostaticlly charged photoconductive surface. An electrostatic image induced on the free surface of the film is developed with electroscopic toner which can be transferred to a copy sheet. The photoconductive surface is thus protected from the abrasive effect of the toner particles.

The present invention provides improvements in contrast and resolution over the Gaynor et al process described above and provides all of its advantages and others. In accordance with the present process, ore uniformly charges one side of a transparent sheet of insulating material, such as a thin insulating film as described in the aforenoted Gaynor et al application, or an electret, and places the charged side against an electrostatically charged or uncharged photoconductive surface on a suitable substrate to form a temporary composite. The photoconductive surface is then exposed to a light pattern and the free surface of the transfer sheet is developed to provide a visible image corresponding to the light pattern. This image is fixed on the transfer sheet or transferred to a receiving sheet. The transfer sheet should be removed from the photoconductive surface when the subsubsequent treatment may affect the electrostatic image (e.g. if fixing of transfer is thermal) or for mechanical facility. In the transfer mode, further copies can be made by reapplying the transfer sheet to the photoconductive surface, if it has been removed, and redeveloping the free surface of the transfer sheet when in place on the photoconductive surface.

Real electrostatic images can be provided on the free surface of the transfer sheet by charging it to a constant voltage, as with a constant voltage-variable current corona device, during or after light exposure. The real electrostatic image can be used to provide multiple visible copies of the image without having to recontact the transfer sheet with the photoconductive surface. This is accomplished by placing the real electrostatic image side of the transfer sheet on a grounded conductor bearing a thin blocking layer and developing the opposite surface of the transfer sheet to provide a visible toner image, transferring the toner image to a copy sheet, and repeating the developing and transferring to provide the desired number of copies.

The present process can also be successfully used when the photoconductive surface is extremely light sensitive and has a high dark decay rate. In one method, the photoconductive surfaces and substrates are transparent. After application of a precharged transfer sheet, the composite is simultaneously exposed and developed (from opposite sides of the composite). In another method, the sandwich is simultaneously charged to constant voltage and exposed.

The present methods provide single or multiple copies in one or a plurality of colors from a single exposure. Moreover, the photoconductive surface is fully protected from wear and contrast loss by the toner. Importantly, the copies are full, sharp, clear and of high contrast and resolution. The process can be carried out in a variety of modes to suit individual needs, all of which modes are characterized, in part, by the use of a precharged transfer sheet of thin insulating film or an electret. The photoconductive surface can be precharged or uncharged. Relatively permanent real electrostatic images can be formed and highly light sensitive, high dark decay rate photoconductors having wide spectral sensitivity can be used efficiently. Further features of the present process are set forth in the following detailed description and accompanying drawings.

BRIEF DESCRIPTION OF THE DRAWINGS

FIG. 7 schematically depicts a photoconductor-transfer sheet composite during exposure in accordance with the present process;

FIGS. 8A and 8B schematically depict the composite of FIG. 7 during charging of the free surface of the transfer sheet to constant positive (8A) or negative (8B) voltage to provide a real electrostatic image;

FIGS. 9A and 9B schematically depict the transfer sheets of FIGS. 8A and 8B, respectively, after real electrostatic image formation thereon and during developing thereof on a grounded conductor;

FIG. 10 schematically depicts the transfer sheet of FIG. 8A, after real electrostatic image formation thereon and during developing in an inverted mode on a grounded conductor bearing a thin blocking layer.

FIG. 11 schematically depicts heat fusion of a toner image on a transfer sheet; and FIG. 12 is a diagrammatic view of a mechanism for accomplishing an embodiment of the invention wherein toner is transferred from the transfer sheet to a receiving sheet and the transfer sheet is reapplied to the photoconductive surface.

DETAILED DESCRIPTION

Figure 1:
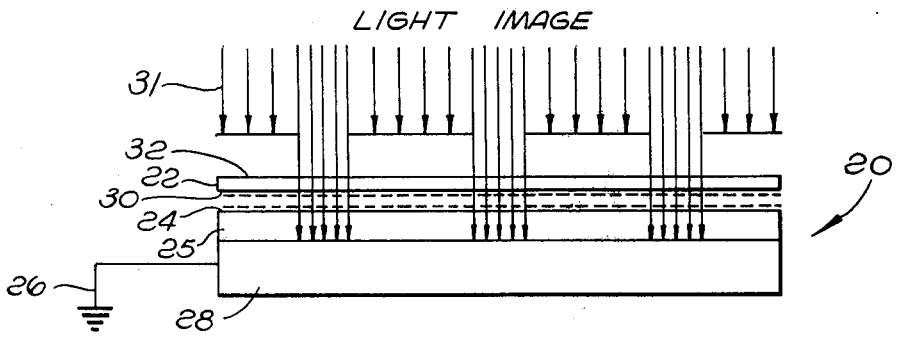
FIG. 1 schematically depicts a photoconductor-transfer sheet composite during exposure in accordance with a first embodiment of the present process.
Figure 2:
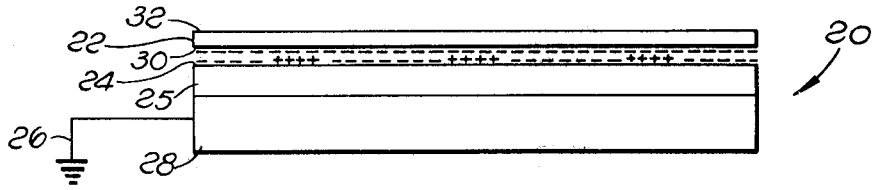
FIG. 2 schematically depicts the composite of FIG. 1 after exposure but before developing.

FIGS. 1 and 2

In accordance with the mode of the present process depicted in FIGS. 1 and 2, a sheet of transparent insulating material, hereinafter termed a transfer sheet, is placed on a photoconductive surface to form a composite. Referring specifically to FIG. 1, a composite 20 is schematically depicted, which comprises a transfer sheet 22 disposed on a photoconductive surface 24 of a photoconductor 25, in turn disposed on a grounded (at 26) conductor plate 28. The transfer sheet 22 can be a thin, electrically, insulating film, for example, of plastic such as thin, smooth, uniform polyethylene terephthalate, polyethylene, polycarbonate, tetrafluoroethylene, polystyrene or the like film which usually is used in a transparent form. In one mode in the present process, more particularly described hereafter in connection with FIGS. 5 and 6, the transfer sheet 22 need not be transparent. The transfer sheet 22 is preferably dimensionally stable, thermally stable and wear resistant. A preferred thickness is, for example, 0.1–2 mil or the like.

The photoconductive surface 24 can be any suitable conventional photoconductive surface, such as cadmium sulfide, zinc sulfide, cadmium sulfide and/or zinc sulfide in a binder resin, or the like. Zinc oxide paper can also be used in this embodiment. Such paper comprises zinc oxide particles in an insulating binder, such as polystyrene, phenolic resin, melamine formaldehyde resin, or the like, coated on a support such as paper. The photoresponse of such paper apparently requires the deposition of oxygen ions on its surface, obtained by direct charging, which is provided in the embodiment of FIGS. 1 and 2. However, in the other embodiments, no pre-charging of the photoconductor is provided and zinc oxide paper would have too low a photoresponse therefor. The conductor plate 28 may be any suitable metal or metal coated glass, etc., for example, a steel plate, suitably grounded at 26 and bearing the photoconductor 25 with its photoconductive surface 24 abutting the transfer sheet 22, particularly the lower surface 30 thereof. The lower transfer sheet surface 30 in all embodiments of the present process is uniformly electrostatically charged before application to the photoconductive surface 24 and is in that condition during said application and exposure, as shown, for example, in FIG. 1. Moreover, in the embodiment depicted in FIG. 1, the photoconductive surface 24 has also been precharged electrostatically to the same polarity as that of transfer sheet surface 30 and is in that state when assembled with the transfer sheet 22 to form the composite 20. It is preferred for this embodiment that the photoconductor surface 25 be of the n-p type.

It is important that there be no electrical discharge between the photoconductive surface 24 and the transfer sheet surface 30 before or after light exposure. Accordingly, the voltage potentials of these surfaces 24 and 30 are selected so as to avoid such discharge during the following image formation.

Upon exposure of the photoconductive surface 24 to a pattern 31 of light-directed through the transfer sheet 22, as shown in FIG. 1, a voltage equal and opposite to that on the charged transfer sheet surface 30 appears on the light exposed areas of the photoconductive surface 24. As a result, the effective voltage difference between the illuminated and non-illuminated areas on the photoconductive surface 24 is the algebraic difference between the original and induced potentials. For example, if the original potentials on the photoconductive surface 24 and transfer sheet surface 30 are each 300 volts negative before exposure, the effective voltage before exposure is 600 volts negative. Where the photoconductive surface 24 is illuminated, a positive 300 volts is induced, effectively neutralizing the negative 300 volts on the transfer sheet surface 30 so far as the electrical field above the free surface 32 of the transfer sheet 22 is concerned. Thus, the effective voltage difference between the illuminated areas and unilluminated areas of the photoconductive surface 24 is 600 volts with or without the transfer sheet 22 subsequently in place.

Thus, by utilizing a precharged transfer sheet 22 in the manner described in the present process, the voltage difference between illuminated and unilluminated areas of the photoconductive surface 24 can be doubled. This doubling of voltage difference provides an increase in electrostatic contrast by a factor of two which automatically increases resolution of the finished copy to be produced. It will be noted from FIG. 2 that in the areas of the free surface 32 of the transfer sheet 22 which corresponds to the unexposed (unilluninated) areas of surface 24, an electrical potential of 600 volts negative appears (assuming the original voltage total, as in the example above, was 600 volts negative) and in the areas of the free transfer sheet surface 32, corresponding to exposed areas of the photoconductive surface 24, the voltage potential is zero.

Accordingly, the free transfer sheet surface 32 can be developed with electroscopic particles of any conventional type welll known and adapted to be attracted to and adhere to the free transfer sheet surface 32 in accordance with the charge pattern thereon. A visible image is thus provided on the free surface 32 of the transfer sheet corresponding to the light pattern to which the photoconductive surface 24 has been exposed, as per FIG. 1. Such development is carried out with the transfer sheet 22 in place on the photoconductive surface 24 as shown in FIG. 1, after which the transfer sheet 22 can be separated from the photoconductive surface 24. Fixing of the visible image on the transfer sheet 22 can be performed as shown in FIG. 11, in any conventional manner, as by heat fusing resin-bearing toner particles 31 in place, to the transfer sheet 22 supported on a platen 33 beneath a heater 35 which can have any conventional form. The visible image can also first be printed off onto a receiving sheet, such as plain bond paper or the like and then fixed on the receiving sheet.

If the visible image obtained as described above is printed off so as to provide the transfer sheet 22 with a toner-free surface 32, the transfer sheet 22 can then be reapplied to the photoconductive surface 24 with its charged lower surface 30 in contact therewith and the free surface 32 of the transfer sheet can be redeveloped with toner to provide a second visible image indentical to the first visible image described above. The redeveloped transfer sheet 22 can then be separated from the photoconductive surface 24, as before, and printed off and fixed as previously described. It will be noted that there is no need to reexpose the photoconductive surface 24 to the light pattern before such redevelopment takes place. Since the voltage potentials of the photoconductive surface 24 and transfer sheet surface 30 still exist, the free transfer sheet surface 32 is provided with the same effective voltage potentials defining the same image pattern as before. Thus, a large number of copies of the same image can be made consecutively utilizing only a single charge and exposure of the photoconductor 25, limited only by its dark decay rate.

Referring to FIG. 12, a device is shown which is identical to an embodiment depicted in above-referred to Gaynor U.S. Pat. No. 3,820,985, except for the additional incorporation of means for electrostatically charging the side of the transfer sheet which is to contact the photoconductor surface and use of indicia to indicate charge. Such apparatus enables the visible image to be printed off onto bond paper and fixed thereon. As stated in the Gaynor et al patent, a xerographic plate having a photoconductive surface 24' and a conductive backing 28' is arranged in the form of a cylindrical drum 14. AThe drum 14 is mounted for rotation on a shaft 16 that is rotated at a predetermined speed by suitable motive means (not shown). An endless belt 22' of light transmitting material is overlaid on a portion of photoconductive surface 24' and is held in direct close contact with the photoconductive surface 24' by means of suitable tensioning means (not shown) operative with various rollers as required for subsequent operations. In this particular configuration, the belt 22' is led over a rubber transfer roller 21 over an idler roller 23, and back onto the photoconductive surface 24' of the drum 14. The drum 14 and belt 22' travel in a counterclockwise direction and a corona charging grid 25 is disposed adjacent the photoconductive surface 24' at a point prior to its contact with the belt 22'. A discharge lamp 27 is disposed at a position prior to the disposition of the corona charging grid 25 and subsequent to separation of the belt 22'from the photoconductive surface 24', all with respect to the direction of travel of the belt 22' and drum 14. A document exposure station 29 is disposed to overlie a contact region of the belt 22' and photoconductive surface 24' and is followed in the course of travel of the drum by a toning station 31 which is also disposed adjacent a contact region between the belt 22' and photoconductive surface 24'.

The toner is attracted to the belt 22' as a result of induced electrostatic forces through the belt and forms a toner image of the document on the belt 22'. The belt 22' can be then separated from the drum surface 24' and may be led with its toner image, as indicated at 33, to a toner transfer station 35.

At the image transfer station 35, the conductive roller 21 compresses the toner bearing belt 22' into contact with a support sheet 37 which is sandwiched between the belt 22' and a metallic roller 39. The support sheet 37 can be a paper sheet or any desired support member to which a toner image will adhere. The metal roller 39 is formed with an axially central heating rod 41, heated by means of a power source shown diagrammatically at 43, so that heat is applied through the support sheet 37 to fuse the toner thereto. The support sheet 37 is fed from a supply 45 thereof by means of a pressure roller 47 actuated in registration with travel of the belt 22' by a mechanism not shown. As the toner image is transferred, the support sheet 37 passes onto a conveyor belt 49 and from there into a receptacle 51.

In accordance with the present invention, and as above indicated, the side of the transfer sheet (belt) 22' which is to contact the photoconductive surface 24' is electrostatically charged, indicated schematically by electrostatic charge means 53, at a point prior to contact with the photoconductive surface 24'.

It will be further noted that a separate, uncharged, transfer sheet 22 can be used for the redevelopment step, if desired, without incurring loss of contrast. In this regard, the latent electrostatic image on the photoconductive surface 24 after the original exposure described above consists (as per the above example) of exposed positively charged areas exhibiting 300+ volts, whereas the unexposed areas of surface 24 exhibit 300− volts. Thus, the 600 volt gradient is still present to provide the original high contrast. The electric field above the free surface of a new, uncharged transfer sheet 22 will exhibit the same voltage gradient so that the new free surface 32 has an induced latent electrostatic image of the same contrast as before, which surface can be developed as before.

Moreover, if a conventional biasing electrode is used while the toner redevelopment step is carried out, positive or negative images on the free transfer sheet surface 32 can be provided with the same toner particles, depending on the sign of the electrode potential employed and its magnitude. It will also be noted that, with or without the biasing electrode, the redevelopment step with an uncharged transfer sheet is carried out in a most favorable environment for very high image quality reproduction, since charged toner particles are attracted during the redevelopment to image-bearing areas having charges opposite to that of the toner and are simultaneously repulsed from the background areas, i.e., non-image bearing areas of the free transfer sheet surface 32 (areas bearing the same charge sign as the toner). This also enables positive and negative images to be toner developed with equal facility and quality using the same process but with different toners.

One should select the material constituting the transfer sheet 22 and the photoconductive surface 24 in order to prevent discharge between the lower charged transfer sheet surface 30 and the photoconductor 25 during original exposure and development (and subsequent redevelopment using the original transfer sheet 22). For example, with a transfer sheet 22 formed with polyethylene terephthalate and a photoconductor 25 formed from selenium, if the voltage gradient is kept below about 650 volts, no discharge will occur. Similar maximum limits for voltage gradients apply to other combinations, and such limits are known to the art or are readily determinable. See, in this regard, "Electrophotography", by R.M. Schaffert, Focal Press, New York, 1965. It will be further understood that the original voltages on the charged transfer sheet surface 30 and the photoconductive surface 24 need not be numerically the same in order to provide the desired results.

Figure 3:
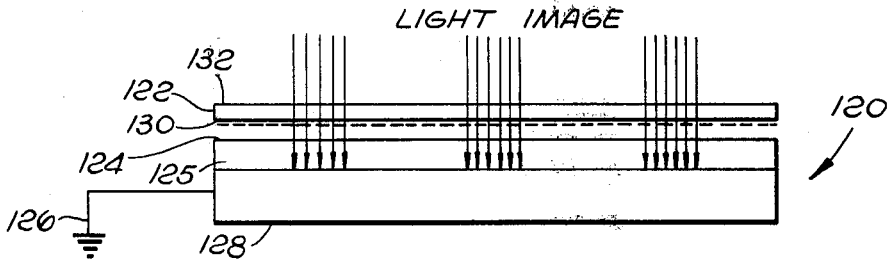
FIG. 3 schematically depicts a photoconductor-transfer sheet composite during exposure in accordance with a second embodiment of the present process.
Figure 4:
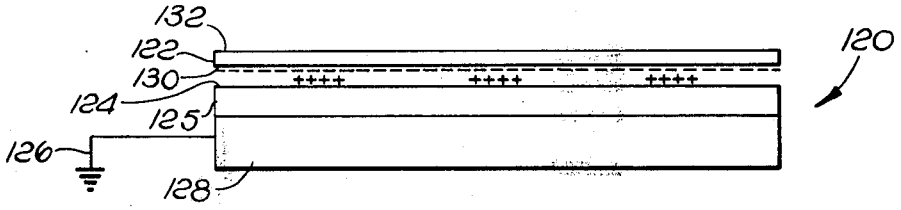
FIG. 4 schematically depicts the composite of FIG. 3 after exposure but before developing.

FIGS. 3 and 4

Now referring to FIGS. 3 and 4, a composite 120 is shown in use during and after exposure. The composite 120 is identical to the composite 20 of FIGS. 1 and 2 except that, in this instance, in contrast to the mode shown in FIG. 1 and 2, the photoconductive surface 124 is in the uncharged state (therefore, one would not use zinc oxide paper as the photoconductor). The lower surface 130 of the transfer sheet is, however, charged, as in FIGS. 1 and 2. For the mode shown in FIGS. 3 and 4, it is preferred that a p-type photoconductor 125 by employed when the electrostatic charge on transfer sheet surface 130 has a negative sign. Suitable examples of p-type photoconductors include: selenium, selenium-tellurium alloys, and polyvinylcarbazole-trinitrofluorenone mixtures. When the charge on the transfer sheet surface 130 is positive, an n-type photoconductor can be used, such as: cadmium sulfide or cadmium selenide. Of course, a n-p type of photoconductor can be used regardless of the polarity of the charge on the transfer sheet surface 130.

Conventional electrostatic charging devices such as a corona charging device, widely used in electrophotographic copying machines, are relatively expensive, inconvenient, sources of maintenance problems, potential hazards and space occupiers. Consequently, elimination of the need for such devices represents a substantial advance in the art. In the mode illustrated in FIGS. 3 and 4, such a need is eliminated because no charging of the photoconductive surface 124 is required. Moreover, although the transfer sheet surface 130 must be charged, it can be precharged in advance of use. Polymeric insulators such as polyethylene terephthalate, polystyrene, tetrafluoroethylene, polyethylene and the like can easily be precharged to the relatively low electrostatic potentials required and can retain their charges for substantial lengths of time. They can also be folded or coil wrapped in thin film form without charge transfer from one surface to another, rendering them ideal for stable precharged transfer sheets and rolls of compact configuration.

Moreover, it is possible to employ as a transfer sheet 122 an electret which would ensure the existence of the charge for a very long time. Electrets are permanently electrified substances well known in the art. They are usually made from polar dielectric materials whose molecules are aligned in an imposed electrical field. Polar plastic materials such as selected vinyls, acetals, acrylics, polyesters and silicones, among others, are well known. Polyethylene terephthalate, for example, can be formed into an electret by polarization at about 85° C.

The magnitude of the voltage charge on the lower surface 130 of the transfer sheet 122 (or through the transfer sheet if it is an electret) must be kept below the threshold which would permit charge transfer to the uncharged photoconductive surface 24. Thus, the voltage gradient, as described for the mode of FIGS. 1 and 2, must be kept below about 650 volts, meaning that the original voltage on the charged transfer sheet surface 130 should not be in excess of about 325 volts.

Once the charged transfer sheet surface 130 is in place on the uncharged photoconductive surface 124, (the photoconductor 125 being disposed on a grounded base conductor 128) the composite 120 is exposed to a light pattern through the transparent transfer sheet 122 so that the light exposes the photoconductor 125. In the areas of the photoconductive surface 124 exposed to light, a potential equal in magnitude and opposite in sign to that on the charged transfer sheet is induced on the photoconductive surface 124. Accordingly, the electrical field above the composite in light exposed areas in zero and toner carrying a positive charge will not deposit. In the unexposed areas of the composite 120, there is an electrical field above the free transfer sheet surface 132 because a similar compensating voltage has not been induced in those corresponding areas of the underlying photoconductive surface 124. Consequently, a visible image corresponding to the light pattern which impinged on the photoconductive surface 124 can be produced on the free transfer sheet surface 132 by toner development in the manner previously described. Such development is conducted with the transfer sheet 122 is place on the photoconductor 125, after which the transfer sheet 122 can be separated therefrom and the visible image is fixed, as previously described, with or without intervening transfer of the visible image to a receiving sheet.

The latent electrostatic image induced in the photoconductive surface 124 will remain for a time proportional to the inherent dark decay rate of the photoconductive surface 124 so that additional image copies can be made (before such decay) in the manner described for the mode of FIGS. 1 and 2, i.e., reapplication of the charged transfer sheet 122 to the photoconductive surface 124, redevelopment in place (without reexposure), removal of the developed transfer sheet 122, print-off of the visible image and repetition of this cycle. The voltage on the charged transfer sheet surface 130 remains constant within its inherent electrical time constant limits.

Figure 5:
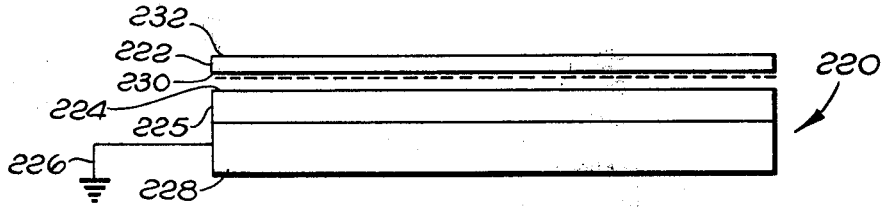
FIG. 5 schematically depicts a photoconductor-transfer sheet composite prior to exposure in accordance with a third embodiment of the present process.
Figure 6:
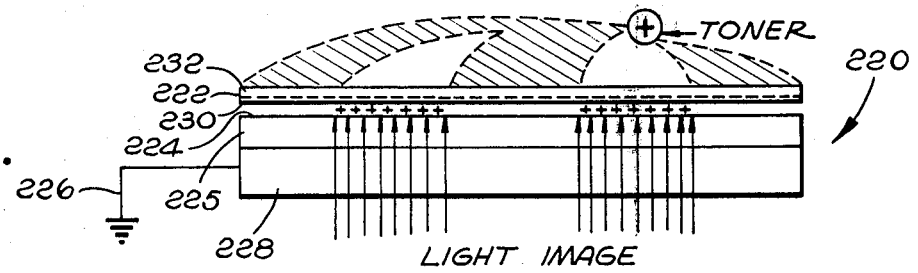
FIG. 6 schematically depicts the composite of FIG. 5 during simultaneous exposure and developing.

FIGS. 5 and 6

Photoconductors which are not good photoinsulators and have high dark decay rates nevertheless can be effectively used in accordance with the present process by the procedure exemplified in FIGS. 5 and 6. The extreme light sensitivity and broad spectral response of certain of such materials gives them advantages in use which can be utilized by the present procedure. They can be successfully used to produce very high resolution copies of very good quality. Examples of such photoconductive materials include: doped cadmium sulfide, cadmium selenide, cadmium telluride and selenium telluride.

Such materials are utlized generally in the mode of FIGS. 3 and 4, modified as shown in FIGS. 5 and 6. Thus, and uncharged surface 224 of a photoconductor 225, disposed on a conductor 228 grounded at 226, is contacted with the electrostatically charged surface 230 of a transfer sheet 222. The transfer sheet 222 is identical to the transfer sheet 122 of FIGS. 3 and 4 and the sheet 22 of FIGS. 1 and 2, but, in contrast to the mode of those Figures, the transfer sheet 222 can be, but need not be, transparent. However, in this embodiment the conductor 228, must be transparent for simultaneous exposure and development. This can be accomplished, as shown in FIG. 6, by exposing the photoconductor 224 to a light pattern through the transparent plate 228 while simultaneously applying charged toner developer to the free surface 232 of the transfer sheet 222.

Although the electrostatic image induced on the photoconductive surface 224 decays very rapidly, it can easily be captured by toner which is simultaneously applied to the free transfer sheet 232. The resulting toner image can then be transferred to a receiving sheet and fixed, or it can be fixed on the transfer sheet 222, if desired. The high decay rate of the photoconductive surface 224 prevents multiple copies of such image from being made by the redevelopment procedure described with respect to FIGS. 3 and 4. However, further copies can be made by repeating the entire procedure, including reexposure of the photoconductive surface 224. Thus, high speed photoconductors previously unusable in photocopying processes can be utilized in the present process be provide high quality copies.

FIGS. 7, 8 and 9

In accordance with another embodiment of this invention, electrostatic images are recorded directly on the free surface of the transfer sheet. Such images can be developed and duplicated without the presence of the photoconductive surface, thus affording modular operation and greater versatility of the present process to permit various types of machine designs. Moreover, electrostatic contrast and resolution can be increased and the duration of the image can be made substantially longer than the decay time of the photoconductive surface so that many copies can be made therefrom.

In accordance with this embodiment, while the transfer sheet is in contact with the photoconductive surface, a real electrostatic image can be produced on the surface of the transfer sheet, thus allowing multiple copying. This is accomplished by charging the surface of the transfer sheet to a constant voltage simultaneously with exposure of the photoconductive surface. If such charging is carried out in the mode of FIGS. 5 and 6, the need to simultaneously expose and develop is obviated, and developing can occur at any time after exposure, since the image so produced on the free transfer sheet surface 232 (332 in FIG. 7) is longlasting. Therefore, the photoconductive surface can be light irradiated either through the supporting transparent conductor 228 or through the transparent transfer sheet.

A constant voltage corona device 334 is used for charging as shown in FIG. 8, parts A and B, which device is known in the art as a variable current or variable charge deposition device. The amount of charge deposited depends on the sign and magnitude of the voltage or the capacitance which the device detects. Thus, if voltage detected is of the same sign as the charges being deposited by the device, then less charge will accumulate in the high voltage area read out by the device. If the device deposits charges of opposite sign to the voltage being detected, more charge will accumulate in the higher voltage areas. High capacitance areas will acquire more charge from the device than low capacitance areas in order to attain the same voltage potential. Electrostatic contrast enhancement is possible with such a device.

Referring particularly to FIG. 7, a composite 320 is provided comprising a conductor plate 328, photoconductor 325 having a photoconductive surface 324, and a transfer sheet 322 having its lower surface 330 in contact with, but removable from, the photoconductive surface 324. The photoconductor 325 or transfer sheet 322 or both, has a uniform (in this case, negative) charge in its contacting surface. The exposure step shown for the composite 320 results in the previously described voltage and capacitance difference between the exposed and unexposed areas of the photoconductive surface 324 (and corresponding areas of transfer sheet surface 332). By the use of a constant voltage-variable current corona charging device 334, as shown in FIG. 8, parts A and B, the differences noted above are recorded on the free surface 332 of the transfer sheet 322 as charge density differences, thereby creating a real, longlasting electrostatic image independent of the decay rate of the photoconductive surface 324. In effect, the internal voltage difference between the light exposed and the unexposed areas of the composite 320 are recorded on the free transfer sheet surface 332 as charge density differences. Depending on the polarity of charging device 334, either a positive or negative real electrostatic image can be recorded on the free transfer sheet surface 332 relative to a one polarity toner. For simplicity, FIGS. 8A and 8B show only charge differentials. FIG. 8, part A, represents the charge density build-up utilizing a free transfer sheet surface 332 processed according to the mode of FIGS. 1 and 2, while FIG. 8, part B, represents the charge density build-up utilizing a free transfer sheet surface 332 processed according to the mode of FIGS. 3 and 4.

So long as the transfer sheet 322, after use of the charging device 334 as per FIG. 8, remains in contact with the photoconductive surface 324 and the composite 320 is kept in the dark, the free transfer sheet surface 332 does not exhibit apparent voltage differences and, thus cannot be toned (except in the case of the high decay rate photoconductor as referred to in FIGS. 5 and 6, after decay). Thus, it is necessary to either remove the transfer sheet 322 from the photoconductive surface 324 and place it on a grounded conductor with the lower transfer sheet surface 330 contacting the same before toning the free surface 332 can take place, or to discharge the photoconductive surface 324 by exposing it to light and then tone the free transfer sheet 332 in place in the composite 320. It is only when either of these steps is taken that the charge differences on the free transfer sheet surface 332 are converted into real voltage differences and toning can proceed.

FIG. 9, parts A and B, depict toning of the free transfer sheet surface 332 shown in FIG. 8, parts A and B, respectively, after application of the lower transfer sheet surface 330 to a conductor 336 grounded at 338. Such toning provides a visible image of high image density and resolution. Moreover, the procedure of FIGS. 7, 8 and 9 is susceptible to an increase in effective photographic speed. However, since the charged toner particles contact the real electrostatic image directly, some charge removal occurs and the numbers of copies which can be made from the real electrostatic image is limited unless the transfer sheet 332 is an electret or a material with electret stability. Accordingly, in many instances, this mode will have particular application where the transfer sheet 332 is to have the visible image affixed directly thereto, as in microimagery, x-ray, transparencies and photographic prints.

Modification of the mode of FIGS. 5 and 6 to encompass real electrostatic image recording on the free transfer sheet surface can be made, as previously described. Thus, simultaneous exposure of the photoconductive surface and developing of the free transfer sheet surface are obviated so long as exposure and constant voltage charging are simultaneous. Furthermore, a precharged transfer sheet is not required. Charge carriers generated in light exposed photoconductor areas produce capacitance differences. The resulting real electrostatic image ccan be developed with the transfer sheet 322 in or out of contact with the photoconductive surface 324, since the charge on the photoconductive surface 324 is automatically dissipated before development (due to the high dark decay rate). However, the photoconductor 325 should be grounded or the transfer sheet 322 should be placed on the grounded conductor 336 as shown in FIG. 9, parts A and B.

FIG. 10

In this embodiment, the real electrostatic image formed by the procedures set forth above is used to make a very large number of copies by applying the side 332 bearing the real electrostatic image to a blocking layer 340 on the grounded conductor 336, rather than placing the lower side 330 of the transfer sheet 332 thereon. The uncharged, or uniformly charged, lower side 330 is now free and exposed and can be developed with toner 342. The blocking layer 340 is very thin and may comprise, for example: aluminum oxide or thin plastic films such as polyethylene or polystyrene. The blocking layer 340 is not critical if the voltage on the transfer sheet is below the breakdown voltage, but is preferred to provide good contrast. The blocking layer 340 prevents drain-off of the charge from charged transfer sheet surface 332 through the conductor 336.

The real electrostatic image on the transfer sheet surface 332 induces a corresponding latent electrostatic image on the uncharged, or uniformly charged, surface 330, which image can be toner developed, transferred to receiving sheets (copy sheets) and fixed, redeveloped, etc. The real electrostatic image is strong and protected from dissipation, since the transfer sheet 322 is an excellent insulator. Accordingly, the lifetime of the real electrostatic image is very great and toner developing of the side 330 does not affect its durability. Extension of the durability of the image to be reproduced is thus accomplished in a simple effective way which readily lends itself to multiple copying and modular layout, with separate exposing and developing-duplicating areas, for more effective and simplified machine construction and operation. A reversal mirror should be used during exposure to produce proper copy image orientation.

In each of the foregoing embodiments, it is preferred that the thin insulating film have high lateral electrical resistivity, at least $10^{14}$ ohms/square of surface, to prevent image spread. High bulk resistivity, at least $10^{15}$ ohm-cm, is desirable to assure localized latent electrostatic images with long electrical lifetime so that number of copies is not limited unnecessarily.

It will also be understood that due to the inherent ability of various modes of the present process to produce multiple copies of the same image from a single exposure, various techniques can be applied for the sequential application of toners of various colors to provide multi-colored copies. It will be further understood that the various modes of the present process are readily adaptable for use with a variety of equipment components heretobefore utilized in the electrostatic copying art. Moreover, the present process, while simple, rapid and effective, produces copies of superior contrast and resolution. Other advantages are as set forth in the foregoing.

Various changes, modifications and alterations can be made in the present process, its steps and parameters. All such changes, modifications and alterations as are within the scope of the appended claims form part of the present invention.

I claim:

1. An electrostatic reproduction device, comprising:
a photoconductive surface;
means for uniformly charging said photoconductive surface to a predetermined polarity;
means for charging one side only of a sheet of insulating transfer material to said polarity;
means for thereafter temporarily placing said charged sheet of insulating transfer material on said photoconductive surface with said one side thereof in contact with said photoconductive surface;
means for exposing said photoconductive surface to a light pattern with said transfer material in place;
means for developing said transfer sheet to form a visible image thereon; and
means for fixing said visible image.

2. The device of claim 1 in which said fixing means comprising means fixing said visible image on said transfer sheet.

3. The device of claim 1 including means for transforming said visible image from said transfer sheet to a receiver sheet, said fixing means comprising means for fixing said visible image on said receiver sheet.

4. The device of claim 1 including means for removing said transfer sheet from said photoconductive surface.

5. The device of claim 4 including means for reapplying said transfer sheet to said photoconductive surface after said removal thereof.

6. An electrostatic reproduction device, comprising:
a photoconductive surface;
means for uniformly charging said photoconductive surface to a predetermined polarity;
means for charging one side only of a sheet of insulating transfer material to said polarity;
means for thereafter temporarily placing said charged sheet of insulating transfer material on said photoconductive surface with said one side thereof in contact with said photoconductive surface;

means for exposing said photoconductive surface to a light pattern with said transfer material in place;

means for charging the other side of said transfer sheet to a constant voltage;

means for developing said transfer sheet to form a visible image thereon; and means for fixing said visible image.

7. An electrostatic reproduction device, comprising:

a photoconductive surface;

means for charging said photoconductive surface;

means for charging one side only of a sheet of insulating transfer material;

means for temporarily placing said one side of said sheet of insulating transfer material on said photoconductive surface;

means for exposing said photoconductive surface to a light pattern;

means for charging the other side of said applied transfer sheet to a constant voltage;

means for developing said transfer sheet to form a visible image thereon; and means for fixing said visible image.

* * * * *

UNITED STATES PATENT AND TRADEMARK OFFICE

CERTIFICATE OF CORRECTION

PATENT NO. : 4,021,106
DATED : May 3, 1977
INVENTOR(S) : Joseph Gaynor

It is certified that error appears in the above-identified patent and that said Letters Patent are hereby corrected as shown below:

Col. 1, line 28, change "abrasivness" to --abrasiveness--.

Col. 1, line 61, change "electrostaticlly" to --electrostatically--.

Col. 2, line 2, change ore to --one--.

Col. 2, line 16, change "of" to --or--.

Col. 5, line 52, change "AThe" to --The--.

Col. 7, line 35, change "by" to --be--.

Col. 8, line 39, change "is" , second occurrence to -- in --

Col. 9, line 4, change "utilized" to --utilized--.

Col. 9, line 17, change "224" to --225--.

Col. 9, line 35, change "be" to --to--.

Col. 11, line 9, change "332" to --322--.

Col. 11, line 12, change "332" to --322--.

Col. 11, line 25, change "ccan" to --can--.

Col. 12, line 5, change "$10^{14}$" to --$10^{13}$--.

Col. 12, line 18, change "heretobefore" to --heretofore--.

UNITED STATES PATENT OFFICE
CERTIFICATE OF CORRECTION

Patent No. 4,021,106 Dated May 3, 1977

Inventor(s) Joseph Gaynor

It is certified that error appears in the above-identified patent and that said Letters Patent are hereby corrected as shown below:

Column 12, line 48, "transforming" to -- transferring --.

Signed and Sealed this twenty-sixth Day of July 1977

[SEAL]

*Attest:*

RUTH C. MASON
*Attesting Officer*

C. MARSHALL DANN
*Commissioner of Patents and Trademarks*